US012291926B1

(12) United States Patent
Tetzlaff et al.

(10) Patent No.: US 12,291,926 B1
(45) Date of Patent: May 6, 2025

(54) AUGER WITH ANCHORING DEVICE AND DURABLE BIT ATTACHMENT

(71) Applicant: ARDISAM, INC., Cumberland, WI (US)

(72) Inventors: Tyler Michael Tetzlaff, Frederic, WI (US); Scott Andrew Waldal, Hudson, WI (US); Brandon Venzke, Rice Lake, WI (US)

(73) Assignee: ARDISAM, INC., Cumberland, WI (US)

( * ) Notice: Subject to any disclaimer, the term of this patent is extended or adjusted under 35 U.S.C. 154(b) by 0 days.

(21) Appl. No.: 18/900,064

(22) Filed: Sep. 27, 2024

(51) Int. Cl.
*E21B 10/44* (2006.01)

(52) U.S. Cl.
CPC ..... *E21B 10/44* (2013.01)

(58) Field of Classification Search
CPC ..... E21B 10/44; F16B 7/04–7/0493
See application file for complete search history.

(56) References Cited

U.S. PATENT DOCUMENTS 1,152,337 A * 8/1915 Nelson ..... E21B 7/005 175/118
2,221,680 A * 11/1940 Parrish ..... E21B 10/44 175/435
2,260,811 A * 10/1941 Kozak ..... B65G 33/32 198/666
2,320,612 A * 6/1943 Kandle ..... E21B 10/44 175/170
2,735,703 A * 2/1956 Goodman ..... E21B 10/44 175/388
3,168,850 A * 2/1965 Tennican ..... F16B 13/0808 411/342
3,710,877 A * 1/1973 Michasiw ..... E21B 10/44 175/18
5,269,572 A * 12/1993 Mefferd ..... F16L 21/06 403/339
6,076,617 A * 6/2000 Berner ..... E21B 11/005 175/18

(Continued)

FOREIGN PATENT DOCUMENTS

KR 20220165151 A * 12/2022 ..... E21B 10/44

OTHER PUBLICATIONS

Collins Dictionary definition of "auger".*
KR 20220165151 translation A (Year: 2022).*
Creatyi, "Creatyi Heavy Duty Closet Rod Brackets Closet Shower Rod Bracket Closet Rod Holders Closet Pole Sockets Closet Rod Supports for 1 ¼ Inch Rod (2 PCS, Silver)," Nov. 17, 2020, URL: https://www.amazon.com/Creatyi-Stainless-Brackets-Bracket-Supports/dp/B08NPDL1TS/?th=1. Accessed Oct. 31, 2024.

(Continued)

*Primary Examiner* — Blake Michener
(74) *Attorney, Agent, or Firm* — Perkins Coie LLP

(57) ABSTRACT

An auger system may include a powerhead, a bit, and an anchoring device. A collar on the bit may be attachable to a rotatable output shaft of the powerhead with a coupler that is positionable around the collar. The collar may include a passageway that does not intersect the rotation axis of the output shaft. The coupler may have a pin that is positionable to extend into the passageway to engage part of the output shaft to resist removal of the bit from the output shaft. The anchoring device may have a tube that is positionable to rest in slots between two lobes extending from a frame of the powerhead. A pintle assembly may pass through the tube and the lobes to rotatably mount the anchoring device on the frame. A toggle and a spring in the pintle assembly may keep the pintle assembly in position.

22 Claims, 15 Drawing Sheets

(56) References Cited

U.S. PATENT DOCUMENTS

| | | | | |
|---|---|---|---|---|
| 6,679,559 | B2 * | 1/2004 | Kelm | E21C 25/58 175/323 |
| 6,871,455 | B1 * | 3/2005 | Cockman | E02D 5/801 52/165 |
| 6,889,779 | B2 * | 5/2005 | Skarlupka, IV | E21B 7/028 173/148 |
| 7,946,355 | B1 * | 5/2011 | Kluge | A01K 97/01 175/323 |
| D697,098 | S | 1/2014 | Hare et al. | |
| 9,528,319 | B1 * | 12/2016 | Dostal | E21B 7/008 |
| 9,999,969 | B1 * | 6/2018 | Walter | B01F 33/50115 |
| 2008/0078565 | A1 * | 4/2008 | Paskar | E21B 15/006 173/31 |
| 2013/0014997 | A1 * | 1/2013 | Fraley | E02D 5/801 175/323 |
| 2014/0308068 | A1 * | 10/2014 | Gonzalez | F16B 41/005 403/286 |
| 2016/0244933 | A1 * | 8/2016 | Blum | E02D 5/34 |
| 2016/0281432 | A1 * | 9/2016 | Queen | E02D 5/56 |
| 2018/0363376 | A1 * | 12/2018 | Jones | B60R 11/06 |
| 2022/0186565 | A1 * | 6/2022 | Kontras | E21B 10/44 |
| 2023/0053768 | A1 * | 2/2023 | Simionescu | E21B 11/005 |
| 2023/0392445 | A1 * | 12/2023 | Dobernig | E21B 10/44 |

OTHER PUBLICATIONS

"Earthquake" document, publicly available in 2022.

Farmer Equipment Sales LTD, "Farmer Equipment 21" Compact Tree Stump Bucket in John Deere quick attach," URL: https://www.farmerequipmentsales.com/store/p172/Farmer_Equipment_21%22_Compact_Tree_Stump_Bucket_in_John_Deere_quick_attach.html#/. Accessed Oct. 31, 2024.

Misakomo, "PTO Extender Adaptor, New Upgraded 70HP 1-⅜" & 6 Spline Female, 1-⅜" & 6 Spline Male," Sep. 5, 2023, URL: https://www.amazon.com/Extender-Adaptor%EF%BC%8CNew-Upgraded-Spline-Female/dp/B0CH9VCM86/. Accessed Oct. 31, 2024.

Outdoor Power Parts, "Retaining Pin by Stihl," URL: https://outdoorpowerparts.com.au/products/retaining-pin. Accessed Oct. 31, 2024.

Robert Bosch Tool Corporation, "Impact Tough™ Bit Holders," URL: https://www.boschtools.com/us/en/impact-tough-bit-holders-43976-ocs-ac/. Accessed Oct. 31, 2024.

Weasler Engineering, "5-80 Series CV Wide Angle PTO Drive Shaft," URL: https://www.weasler.com/product/5-80-series-cv-wide-angle-PTO-drive-shaft-4/. Accessed Oct. 31, 2024.

* cited by examiner

AUGER WITH ANCHORING DEVICE AND DURABLE BIT ATTACHMENT

BACKGROUND

An auger is often used for boring or drilling a hole in the ground for planting or construction (e.g., making a hole for piling), in ice for ice fishing, or other uses. Some conventional augers may be used by one or two operators that support and control the auger with their hands. Such augers may include a powerhead portion that supports or includes a source of mechanical rotation, such as an engine or a motor, and a bit connected to the powerhead portion. The bit may include a cutting portion such as a helical blade for boring or drilling into the ground when the powerhead rotates the bit. Conventional augers suffer from several drawbacks.

For example, the interface between the bit and the output of the powerhead must accommodate high torque to effectively transfer the torque from the powerhead to the bit. In some conventional augers, this interface includes a pin or a bolt that passes through the powerhead output and the bit. But these pins or bolts can wear out over time and shear off, or they can damage the bit or the powerhead output in a way that seizes the bit to the powerhead, requiring downtime for repair to the auger.

Some augers may also include an anchoring device to help a user resist torque from the auger during operation. The anchoring device may be attached to a frame of the powerhead portion and extend laterally and downwardly to contact the ground. Conventional attachment interfaces between an anchoring device and a powerhead frame tend to be unwieldy or insufficiently secure. For example, they may have overly complex mechanisms, or they may have mechanisms that are not sufficiently durable for the auger environment. A user seeking to change or remove an anchoring device from a powerhead may be faced with unnecessary difficulty.

Aspects of embodiments of the present technology address these drawbacks and other drawbacks.

SUMMARY

Representative embodiments of the present technology include an auger system having a powerhead, a bit, and an optional anchoring device for engaging a fixed surface. The powerhead may include a frame and a rotatable output shaft configured to be driven by a rotatable output source. The bit may be attachable to the rotatable output shaft via a collar and a coupler.

The collar may include a passageway extending along a direction that is transverse to a rotation axis of the rotatable output shaft, and it may not intersect the rotation axis. The coupler may be positionable around the collar. A pin may extend from an inner surface of the coupler to be positionable in the passageway of the collar. In some embodiments, the coupler includes two arcuate portions pivotably attached to each other. At least one of the arcuate portions may be formed with a resilient or elastic material that biases the portion toward a greater curvature so that the coupler grips the collar. When the bit is engaged with the rotatable output shaft via the collar, and when the pin is in the passageway, the pin resists separation of the bit the rotatable output shaft.

The anchoring device is attachable to the frame and removable from the frame. In some embodiments, the anchoring device comprises a tube positionable between two lobes on the frame, the lobes having ledges or slots for supporting the tube. A pintle assembly may pass through the tube and the lobes to secure the anchoring device to the frame while still allowing the anchoring device to pivot relative to the frame. The pintle assembly may include a toggle to resist removal of the pintle assembly from the auger system, and a spring to help limit movement of the toggle.

Other features and advantages will appear hereinafter. The features described herein can be used separately or together, or in various combinations of one or more of them.

BRIEF DESCRIPTION OF THE DRAWINGS

In the drawings, the same reference number indicates the same element throughout the several views.

FIG. 4A illustrates a collar separated from a rotatable output shaft of the powerhead. FIG. 4B shows the rotatable output shaft positioned in the collar. FIG. 4C shows the rotatable output shaft positioned in the collar, and the coupler partially installed on the collar.

DETAILED DESCRIPTION

The present technology is directed to augers with anchoring devices or durable bit attachments, and associated systems and methods. Various embodiments of the technology will now be described. The following description provides specific details for a thorough understanding and enabling description of these embodiments. One skilled in the art will understand, however, that the invention may be practiced without many of these details. Additionally, some well-known structures or functions may not be shown or described in detail so as to avoid unnecessarily obscuring the relevant description of the various embodiments. Accordingly, embodiments of the present technology may include additional elements or exclude some of the elements described below with reference to FIGS. 1A-6D, which illustrate examples of the technology.

The terminology used in this description is intended to be interpreted in its broadest reasonable manner, even though it is being used in conjunction with a detailed description of certain specific embodiments of the technology. Certain terms may even be emphasized below; however, any terminology intended to be interpreted in any restricted manner will be overtly and specifically defined as such in this detailed description section.

Where the context permits, singular or plural terms may also include the plural or singular term, respectively. Moreover, unless the word "or" is expressly limited to mean only a single item exclusive from the other items in a list of two or more items, then the use of "or" in such a list is to be interpreted as including (a) any single item in the list, (b) all the items in the list, or (c) any combination of items in the list. Numerical adjectives including "first" and "second," or the like, as used in the present disclosure, do not convey hierarchy or specific features or functions. Rather, such numerical adjectives are intended to aid the reader in distinguishing between elements which may have similar nomenclature, but which may differ in position, orientation, or structure. Accordingly, such numerical adjectives may be used differently in the claims. As used herein, the terms "generally" and "approximately" refer to values or characteristics within a range of ±10% from the stated value or characteristic, unless otherwise indicated. For purposes of the present disclosure, a first element that is positioned "toward" an end of a second element is positioned closer to that end of the second element than to a middle or mid-length location of the second element.

Auger System

Figure 1A:
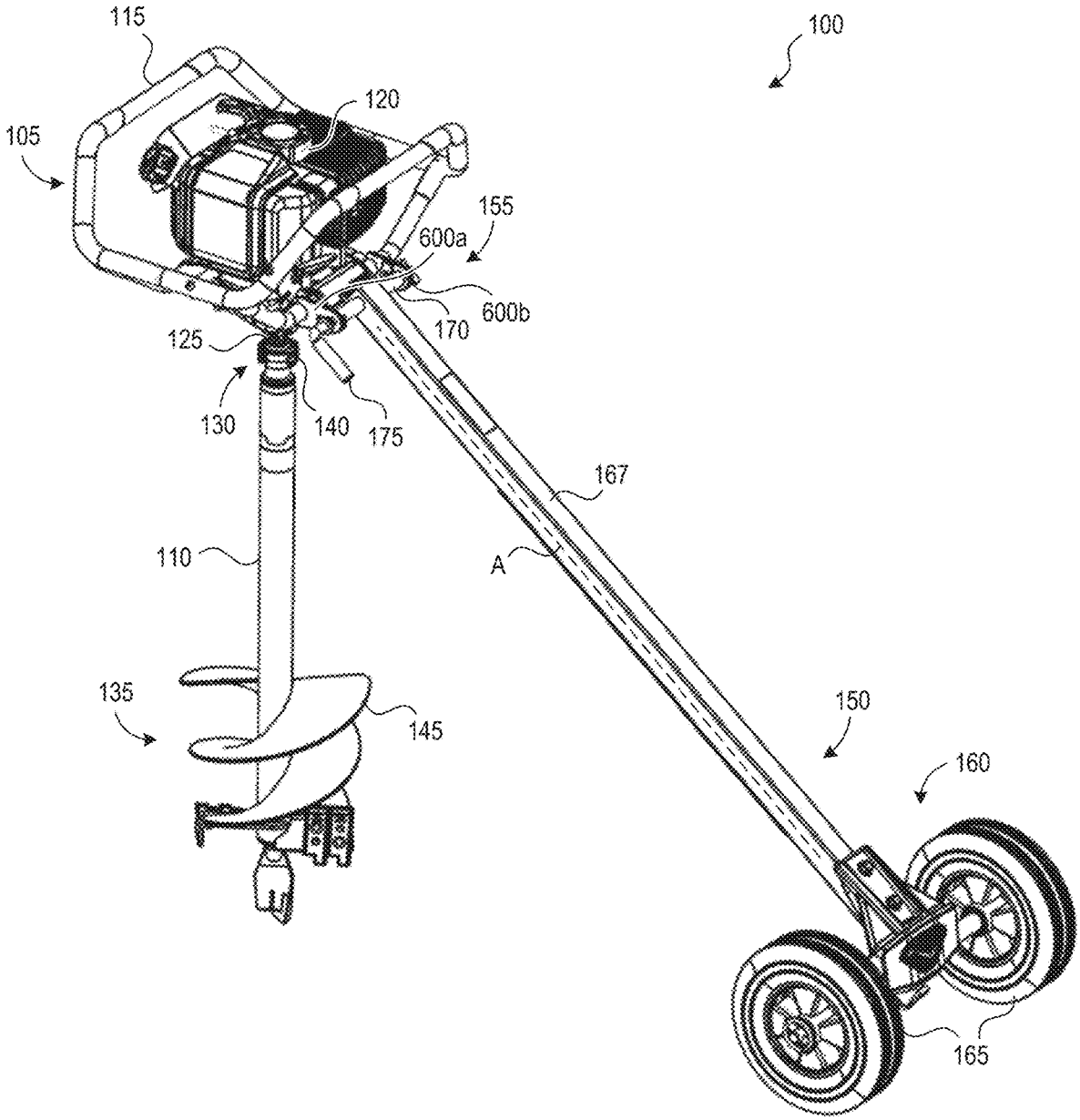
FIG. 1A illustrates a perspective view of an auger system configured in accordance with embodiments of the present technology.
Figure 1B:
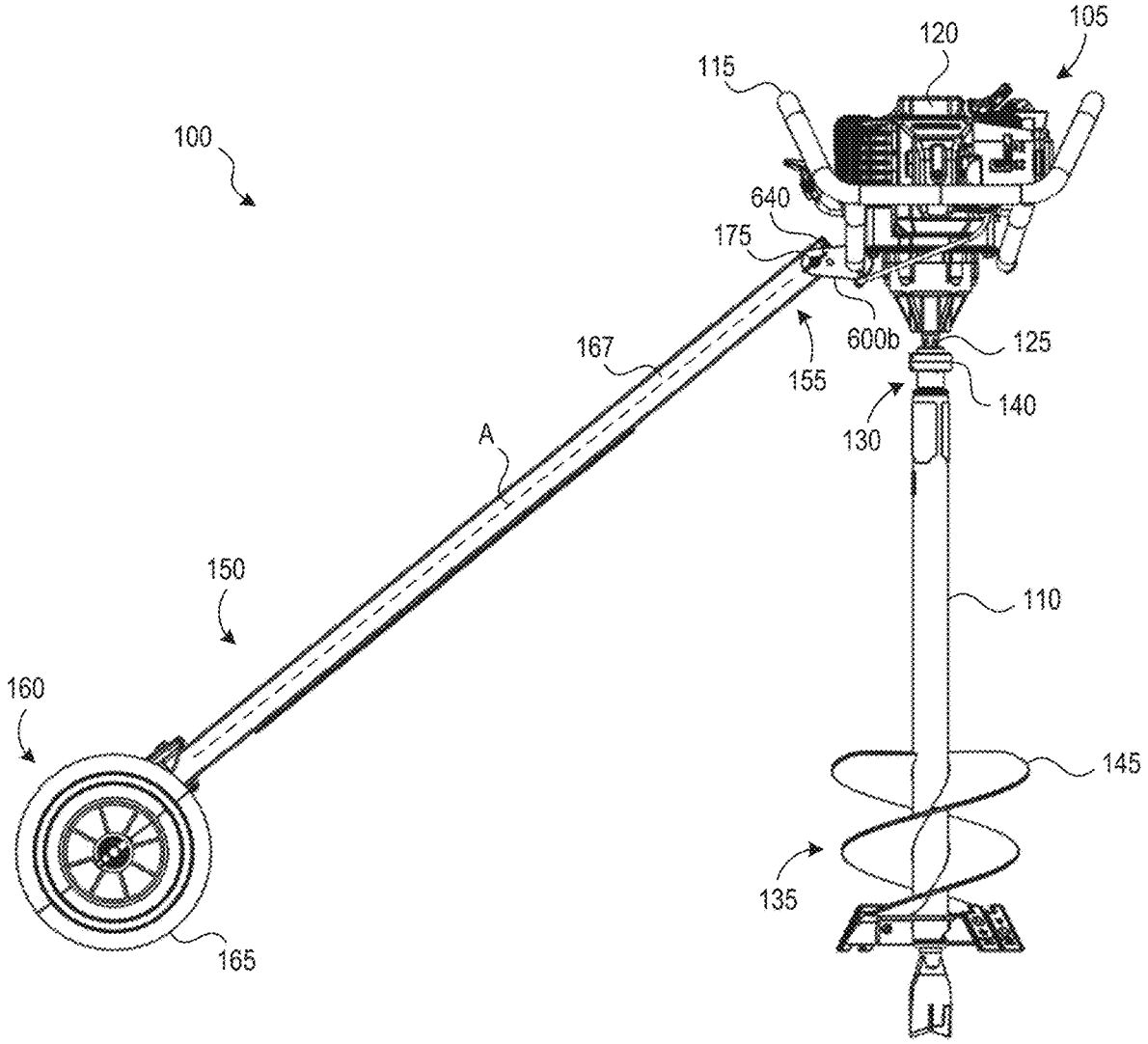
FIG. 1B illustrates a side view of the auger system shown in FIG. 1A.

FIG. 1A illustrates a perspective view of an auger system 100 configured in accordance with embodiments of the present technology. FIG. 1B illustrates a side view of the auger system 100 shown in FIG. 1A. With reference to FIGS. 1A and 1B, in some embodiments, the auger system includes a powerhead 105 and a bit 110.

The powerhead 105 may include a frame 115 for supporting a rotatable output source 120, which may include an internal combustion engine, an electric motor, or another source of torque and rotation for driving the bit 110 (e.g., via a rotatable output shaft 125 connecting the rotatable output source 120 to the bit 110, as described in additional detail below). The bit 110 extends between a first bit end 130 and a second bit end 135. The first bit end 130 is attachable to the rotatable output shaft 125 (e.g., via a coupler 140 described in additional below). The second bit end 135 carries a cutting portion 145 for cutting into a medium, such as drilling into a ground surface. The cutting portion 145 can include a helical blade, teeth, or any other structure suitable for disturbing the medium intended to be drilled or cut.

In some embodiments, the auger system 100 further includes an optional anchoring device 150. The anchoring device 150 provides stability and resistance against rotation of the frame 115 in response to the reaction torque from the bit 110 engaging the ground or other medium during operation. The anchoring device 150 includes a first anchoring device end 155 and a second anchoring device end 160 positioned opposite the first anchoring device end 155 along a longitudinal axis A of the anchoring device 150. The first anchoring device end 155 is releasably attachable to the frame 115 for an operator to use the anchoring device 150 if desired or to remove the anchoring device 150 for transport, shipment, etc. The second anchoring device end 160 is configured to engage a fixed surface. In some embodiments, the second anchoring device end 160 includes wheels 165 to facilitate some lateral movement of the powerhead 105, for example, to enable the user to tilt or straighten the auger system 100 for the desired cutting or drilling angle. In some embodiments, the anchoring device 150 includes a shaft 167 extending between the first anchoring device end 155 and the second anchoring device end 160 for spacing the second anchoring device end away from the frame 115.

The anchoring device 150 includes a tube 170 (see FIG. 1A) that may pass through the first anchoring device end 155 (e.g., through the shaft 167) along a direction transverse to the longitudinal axis A of the anchoring device 150, or which may be attached to the first anchoring device end 155 in another suitable manner to extend transverse to the longitudinal axis A. The auger system 100 may further include a removable pintle assembly 175 that is positionable to extend through one or more portions of the frame 115 and the tube 170 to facilitate a releasable and pivotable connection between the anchoring device 150 (specifically the first anchoring device end 155) and the frame 115, as described in additional detail below.

Couplers for Connecting the Bit to the Powerhead

Figure 2A:
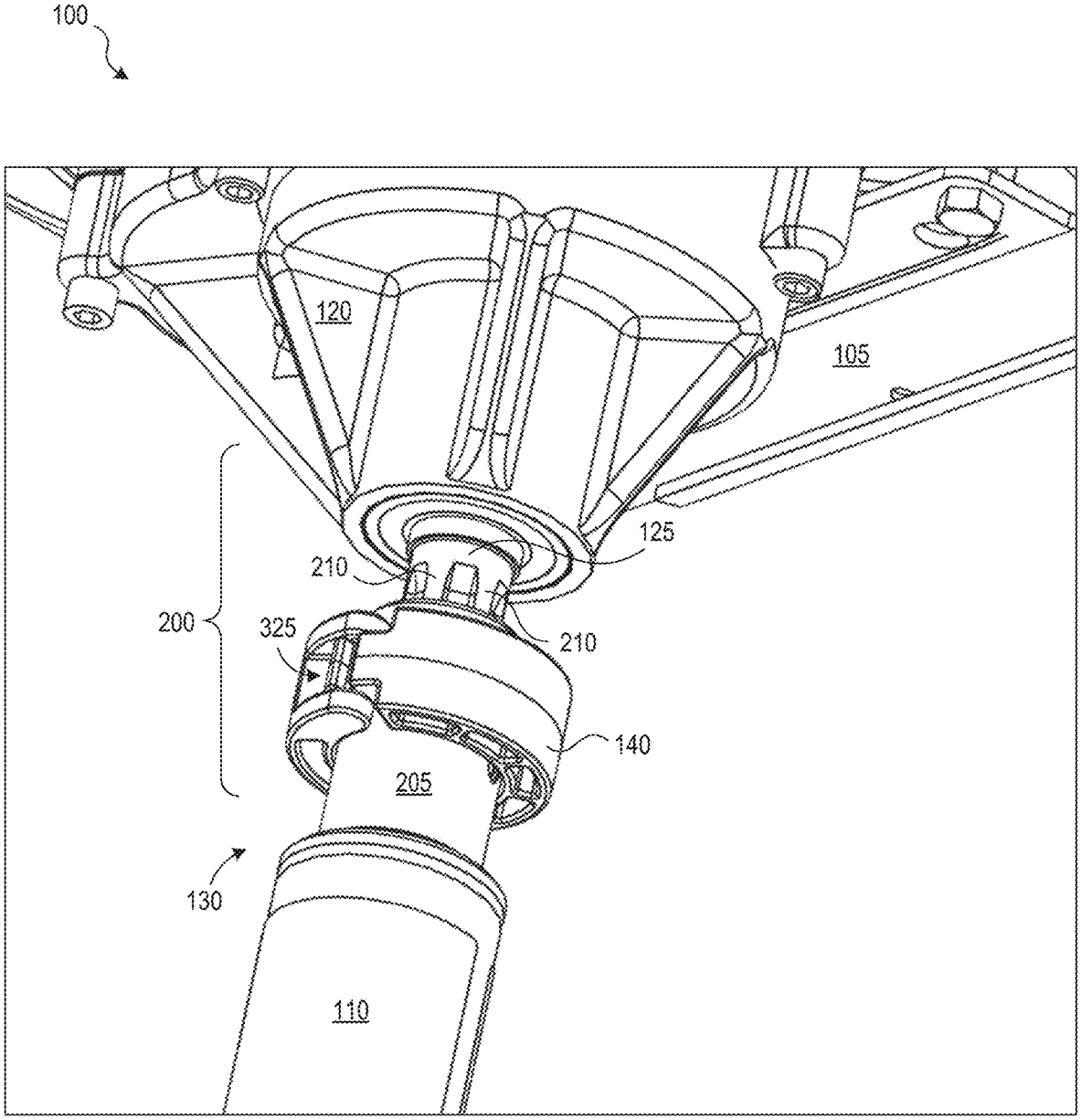
FIG. 2A illustrates a detailed perspective upward view of a connection between a powerhead and a bit of the auger system, according to embodiments of the present technology.
Figure 2B:
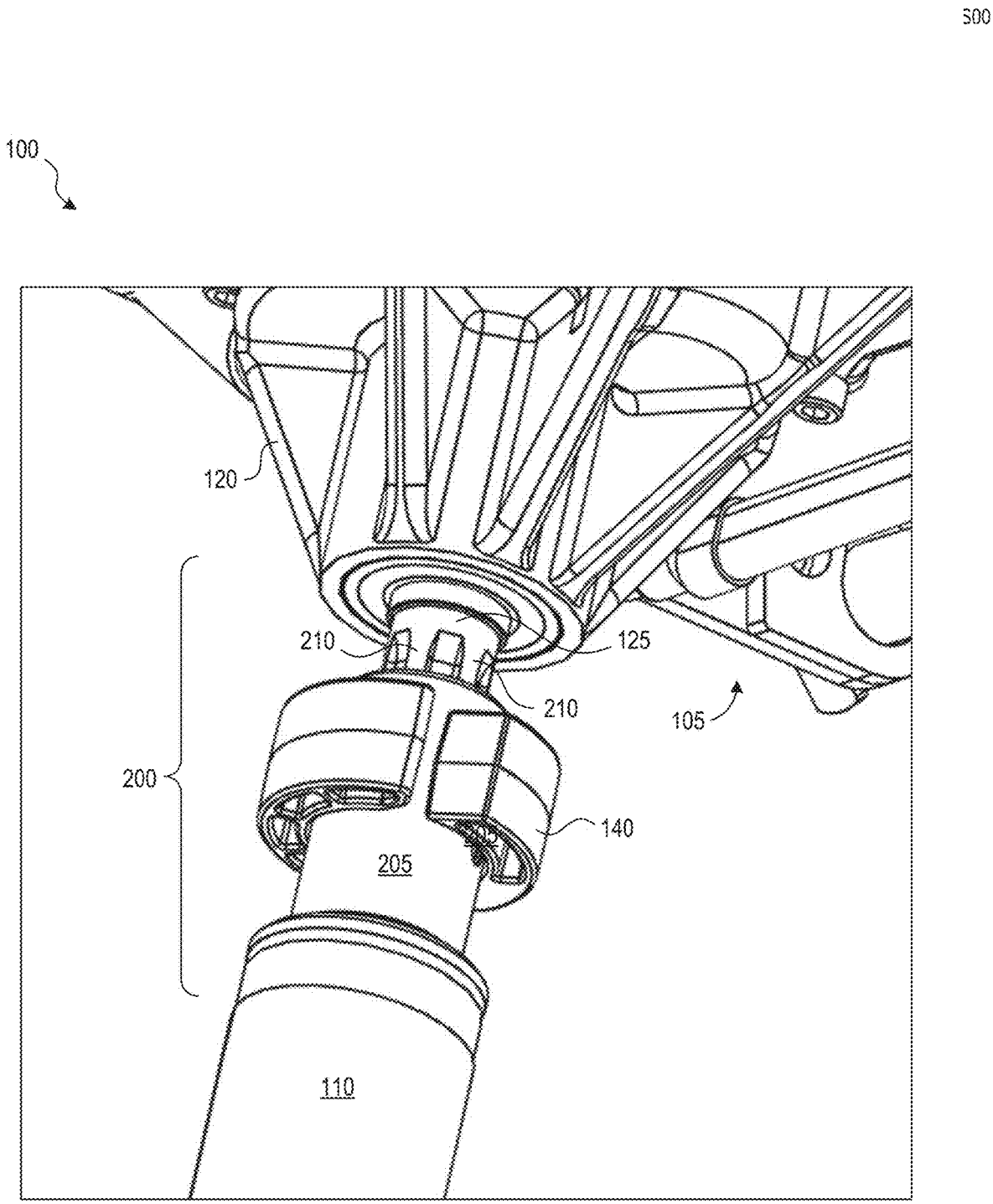
FIG. 2B illustrates a detailed perspective upward view of the connection shown in FIG. 2A, from another viewing angle.

FIG. 2A illustrates a detailed perspective upward view of a connection 200 between the powerhead 105 and the bit 110 according to embodiments of the present technology. FIG. 2B illustrates a detailed perspective upward view of the connection 200 shown in FIG. 2A, with the auger system 100 rotated to show another side of the connection 200. With reference to FIGS. 2A and 2B, the bit 110 may include a collar 205 (e.g., at the first bit end 130) that receives the rotatable output shaft 125 (which is driven by the rotatable output source 120). In some embodiments, the rotatable output shaft 125 may be keyed or otherwise removably mated to the collar 205 to transfer rotation/torque between the rotatable output shaft 125 and the collar 205 and to prevent or at least resist relative rotation between the rotatable output shaft 125 and the collar 205 (and the remainder of the bit 110) when the rotatable output shaft 125 is in the collar 205. For example, the rotatable output shaft 125 can include one or more longitudinal splines 210 (e.g., radial projections with radial recessions in between) that engage corresponding splines within a bore inside the collar 205, as described in additional detail below.

The connection 200 may further include the coupler 140, which can at least partially surround a perimeter of the collar 205 when the coupler 140 is positioned around the collar 205. The coupler 140 is removable and attachable the collar 205 and includes a pin extending from the coupler 140 into the collar 205 that prevents the rotatable output shaft 125 from being removed longitudinally from the collar 205, as described in additional detail below.

Figure 3A:
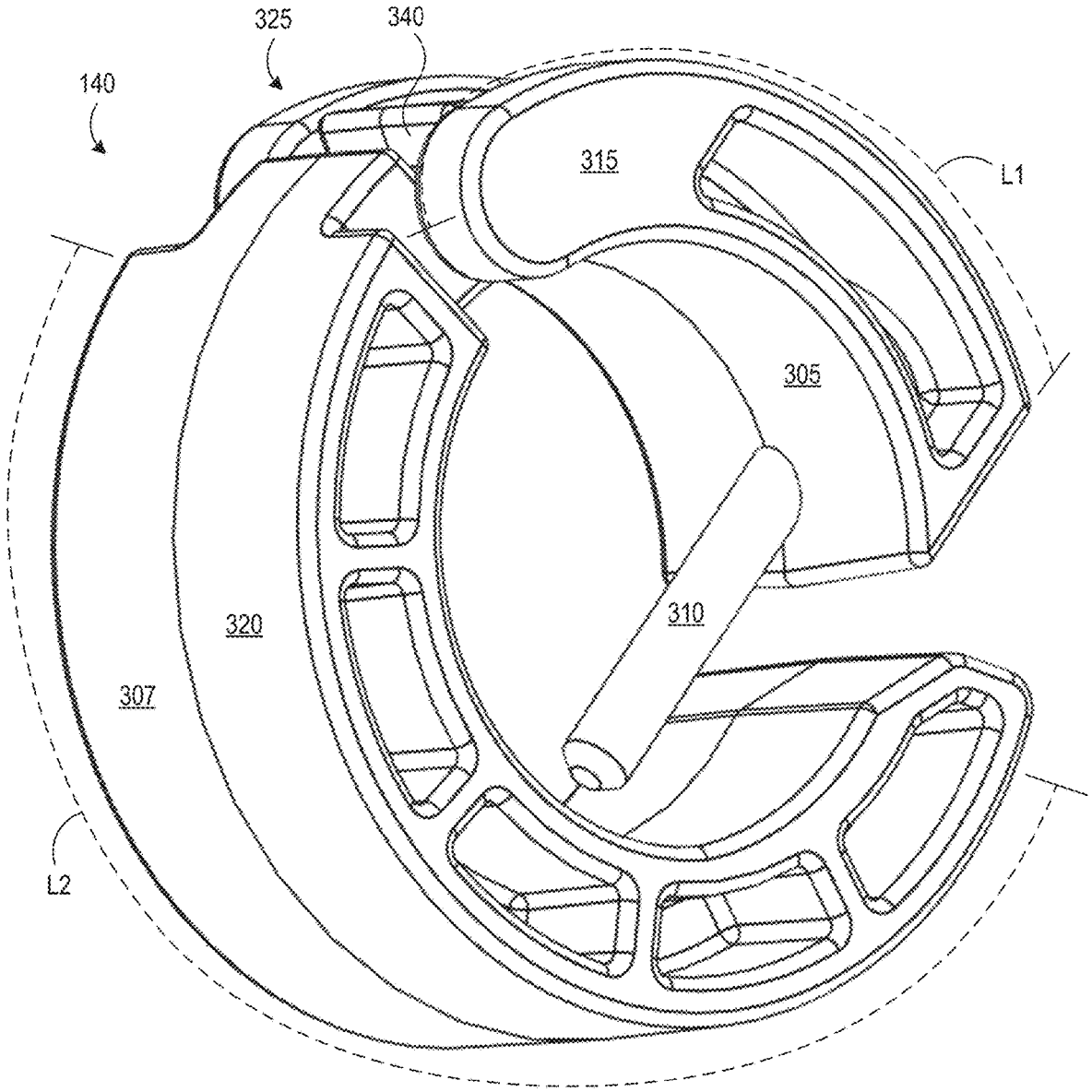
FIG. 3A illustrates a perspective view of a coupler for connecting a bit to a powerhead, according to embodiments of the present technology, with the coupler being in a closed configuration.
Figure 3B:
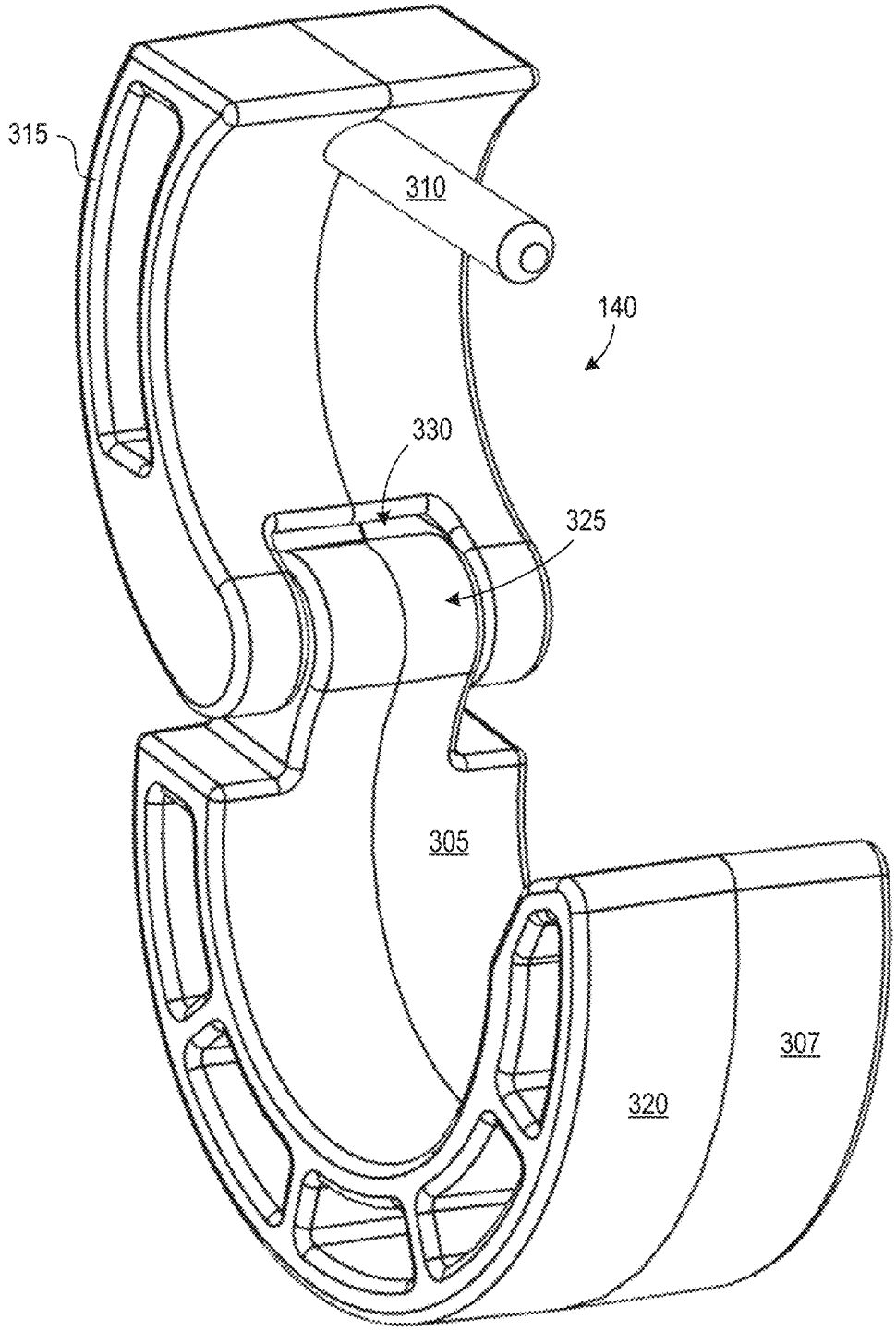
FIG. 3B illustrates a perspective view of the coupler shown in FIG. 3A, in an open configuration.
Figure 3C:
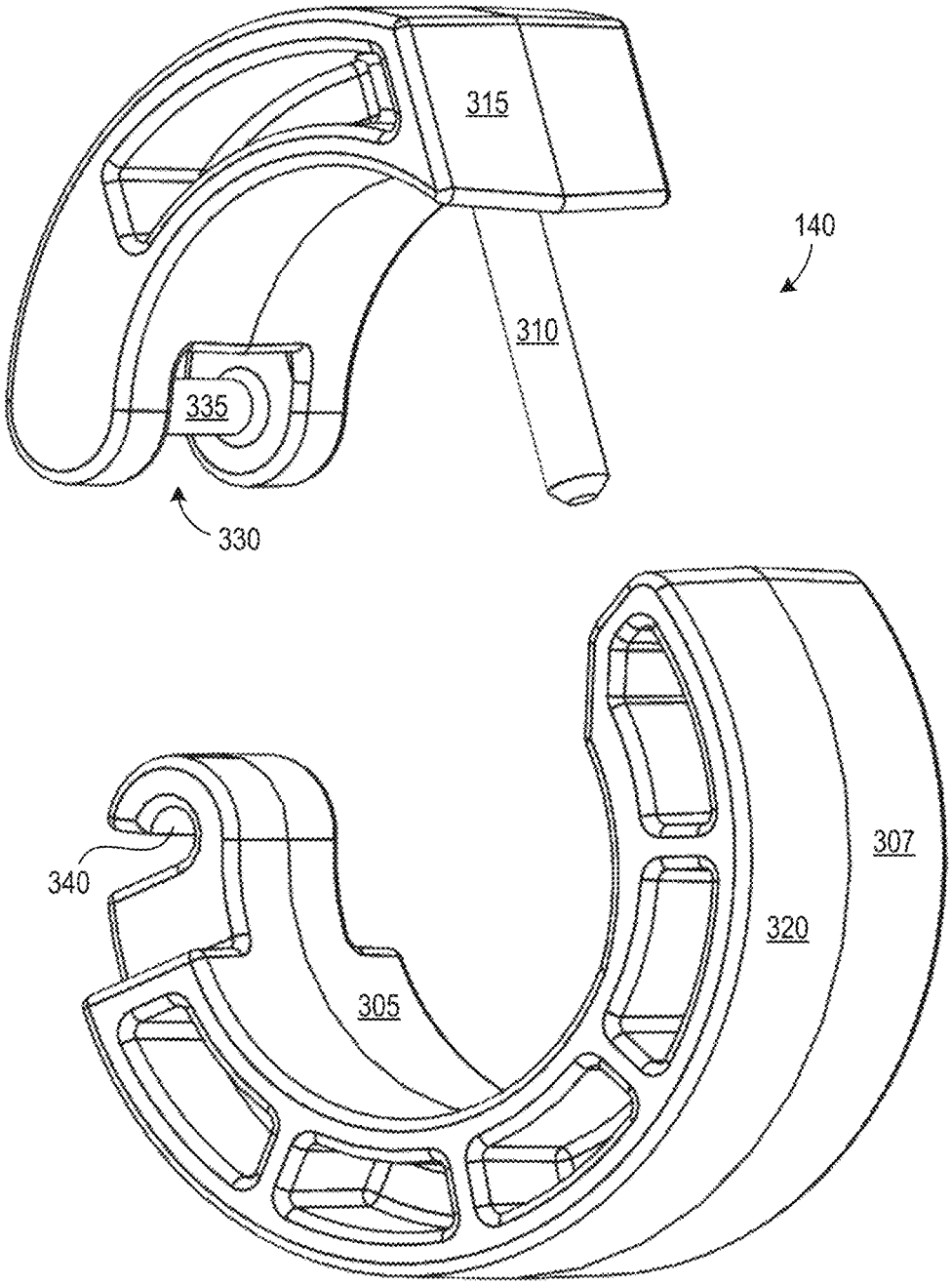
FIG. 3C illustrates a perspective view of the coupler shown in FIG. 3A, in a partially disassembled configuration.

FIG. 3A illustrates a perspective view of the coupler 140, according to embodiments of the present technology, in a closed configuration. FIG. 3B illustrates a perspective view of the coupler 140 shown in FIG. 3A, in an open configuration. FIG. 3C illustrates a perspective view of the coupler 140 shown in FIG. 3A, in a partially disassembled configuration. With reference to FIGS. 3A, 3B, and 3C, in some embodiments, the coupler 140 comprises an inner surface 305 positionable to face the collar 205, an outer surface 307 positionable to face away from the collar 205, and a pin 310 extending from the inner surface 305. The pin 310 prevents the rotatable output shaft 125 from being removed longitudinally form the collar 205. In some embodiments, the coupler 140 is a resilient or elastic arcuate structure that grasps the collar 205 to support itself on the collar 205 while holding the pin 310 in the auger system 100.

For example, in some embodiments, the coupler 140 comprises a first arcuate portion 315 and a second arcuate portion 320. The first arcuate portion 315 and the second arcuate portion 320 may be separate but attachable to each other via a hinge 325. In some embodiments, the first arcuate portion 315 and the second arcuate portion 320 may be integral with each other (e.g., the hinge 325 may be a living hinge or another flexible connection). In the illustrated embodiment shown in FIGS. 3A, 3B, and 3C, the hinge 325 may be formed with a notch 330 in one of the arcuate portions (e.g., the first arcuate portion 315), and a hinge rod 335 spanning the notch 330 for engaging a hook 340 at an end of the other arcuate portion (e.g., the second arcuate portion 320). The hook 340 may be open-ended to receive the hinge rod 335 and facilitate pivoting or hinging of the arcuate portions 315, 320 to open and close the coupler 140 (e.g., pivoting between an open configuration as shown in FIG. 3B and a closed configuration shown in FIG. 3A, or a disassembled configuration as shown in FIG. 3C).

In some embodiments, with reference to FIG. 3A, the first arcuate portion 315 has a first arcuate length L1, the second arcuate portion 320 has a second arcuate length L2. The second arcuate length L2 may be greater than the first arcuate length L1, or they may have different relative sizes. In some embodiments, the second arcuate portion 320 may wrap around the collar 205 by more than 180 degrees. To stay grasped to the collar 205, at least one of the arcuate portions 315, 320 may include a resilient or elastic material that biases the at least one of the arcuate portions 315, 320 toward greater curvature. In some embodiments, the curvature of one or both of the arcuate portions (specifically, of their inner surfaces that face the collar 205) is less than a curvature of the collar 205, so that the coupler 140 may tightly engage the collar 205. The coupler 140 (or portions thereof) may effectively spring closed around the collar 205, which may eliminate a need for a more complex spring mechanism to close the coupler 140. The pin 310 may be carried by, and extend from, either arcuate portion 315, 320, but in a representative embodiment, the pin 310 may be carried by, and extend from, the arcuate portion with the shorter arcuate length (i.e., the first arcuate portion 315).

Figure 4A:
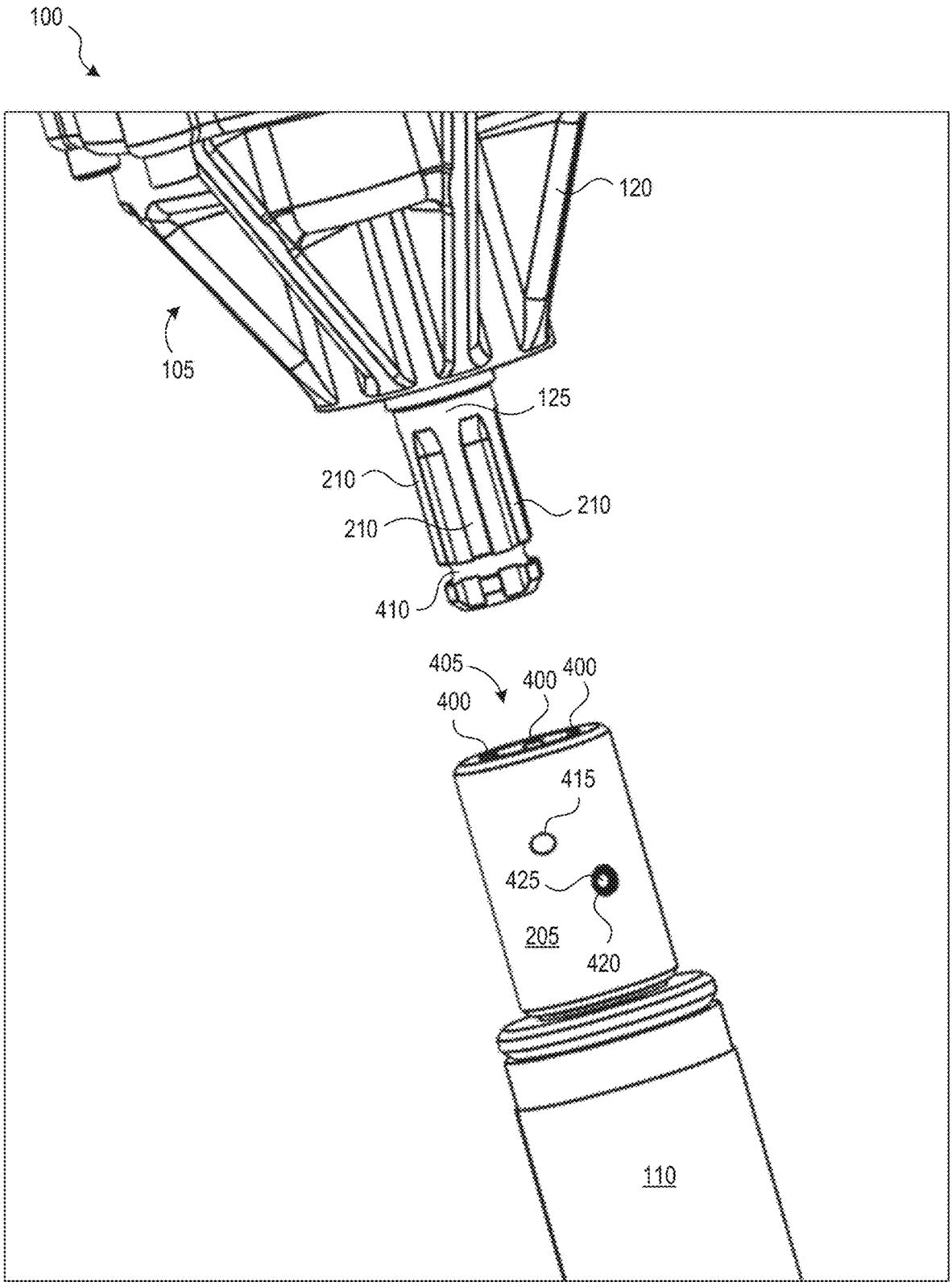
FIGS. 4A, 4B, and 4C illustrate perspective views of portions of the auger system in varying states of assembly or disassembly.
Figure 4B:
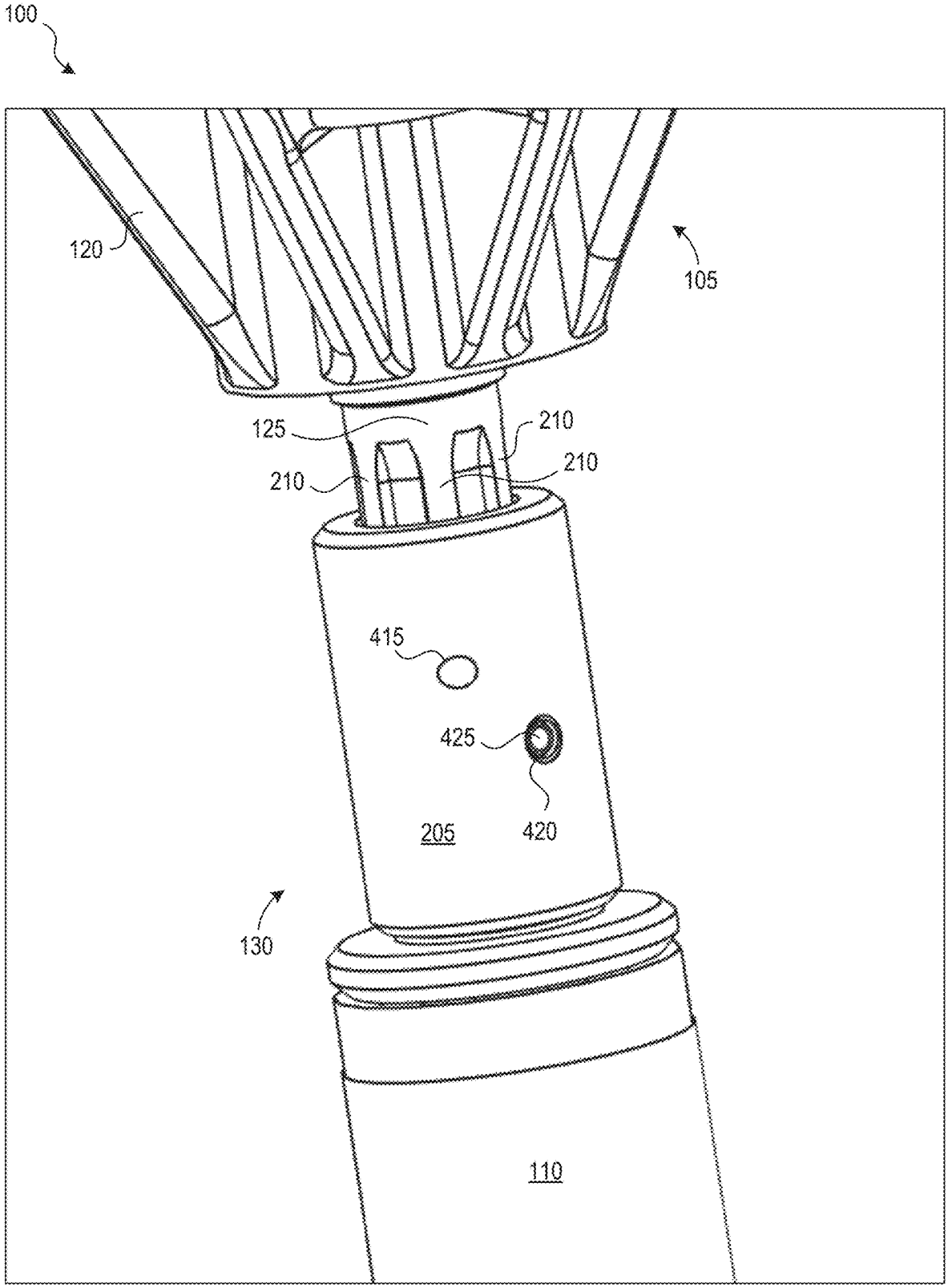
Figure 4C:
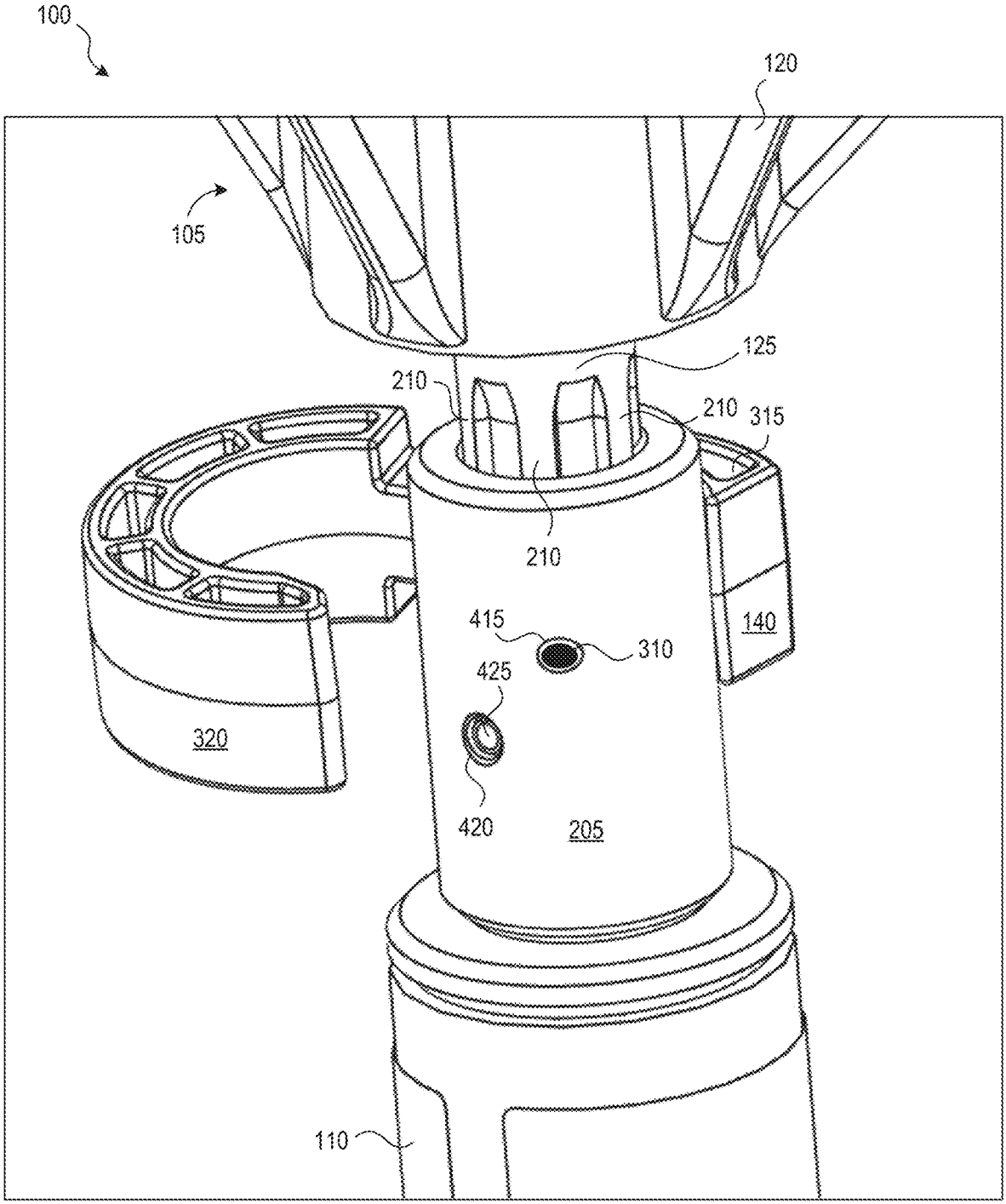

FIGS. 4A, 4B, and 4C illustrate perspective views of portions of the auger system 100 in varying states of assembly or disassembly. In particular, FIG. 4A illustrates the collar 205 separated from the rotatable output shaft 125 (the rotatable output shaft 125 is out of the collar 205). Splines 400 in a bore 405 of the collar 205 are visible in FIG. 4A for engaging the splines 210 of the rotatable output shaft 125 when the rotatable output shaft 125 is positioned in the bore 405 of the collar 205. In some embodiments, the rotatable output shaft 125 includes a notch 410 on the perimeter of the rotatable output shaft 125 (e.g., a circumferential notch). As described in additional detail below, the notch 410 receives the pin 310 of the coupler 140 (the coupler 140 is not shown in FIG. 4A).

FIG. 4B shows the rotatable output shaft 125 positioned in the collar 205. In this configuration, the rotatable output shaft 125 does not rotate relative to the collar 205 or the remainder of the bit 110 (e.g., because of the splines), but the rotatable output shaft 125 may still be pulled out of the collar 205 (i.e., the rotatable output shaft 125 has not yet been secured inside the collar 205 because the pin 310 has not yet been installed in the configuration shown in FIG. 4B). The collar 205 may include a first passageway 415 (e.g., a through-hole) in the collar 205 for receiving the pin 310 in the collar 205. In some embodiments, the collar 205 may include a second passageway 420 (e.g., a through-hole) in the collar 205 below the first passageway 415 for receiving an alignment pin 425, which may be a spring pin or another suitable pin or bar extending at least partially through the collar 205 for controlling a depth that the rotatable output shaft 125 penetrates the collar 205, as explained in additional detail below.

FIG. 4C shows the rotatable output shaft 125 positioned in the collar 205, and the coupler 140 partially installed on the collar 205. In FIG. 4C, the pin 310 is positioned in the passageway 415 to keep the rotatable output shaft 125 in the collar 205. The first arcuate portion 315 is adjacent to the outer surface of the collar 205. The second arcuate portion 320 can be pivoted relative to the first arcuate portion 315 from the open position shown in FIG. 4C to the closed position shown in FIGS. 2A and 2B. Because the second arcuate portion 320 may have a curvature that is less than the curvature of the collar 205, the second arcuate portion 320 may tightly hold the collar 205 to keep the pin 310 in the passageway 415 during operation of the auger system 100 (e.g., when the bit 110 is spinning relative to the powerhead 105).

Figure 5:
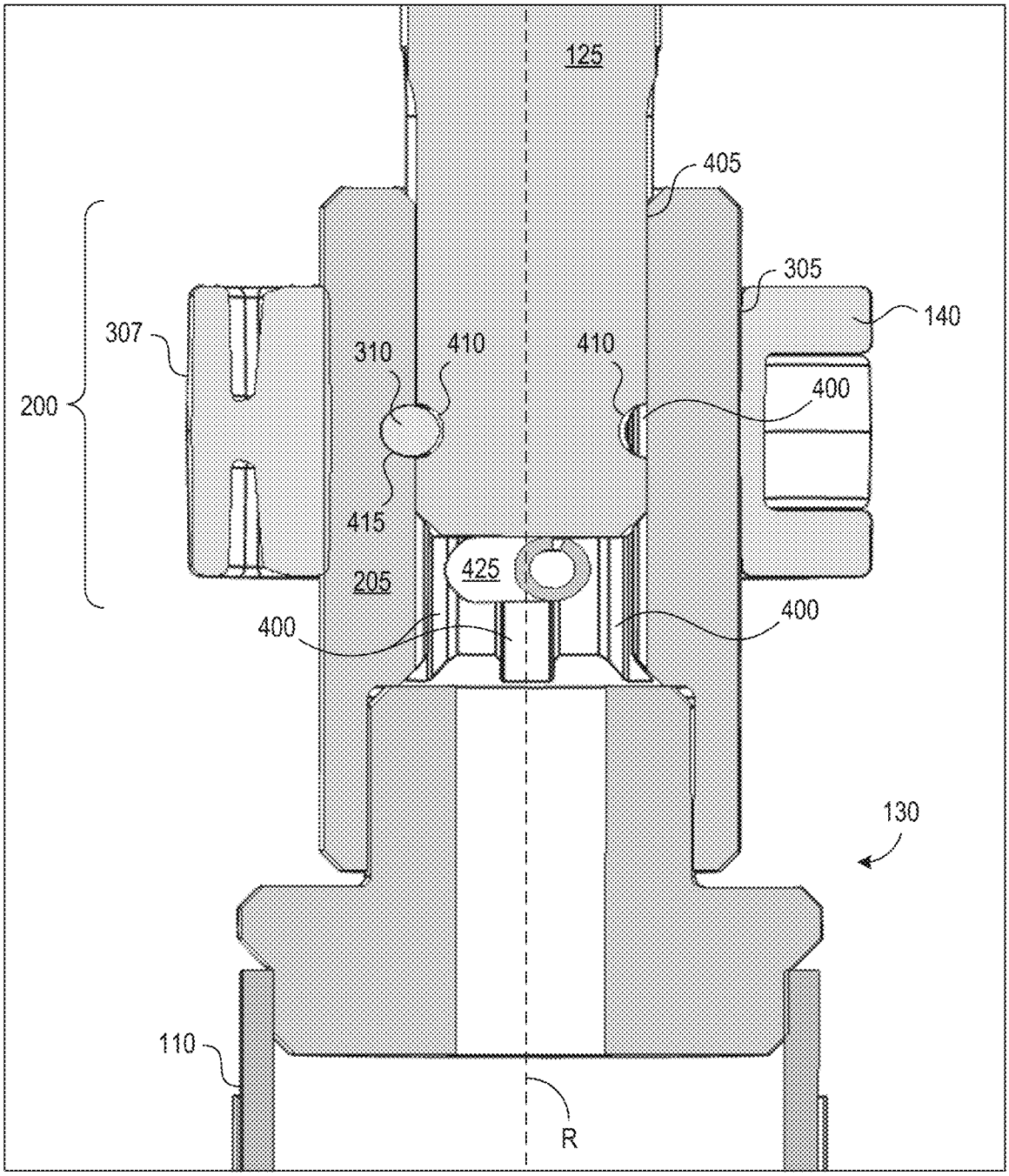
FIG. 5 illustrates a cross-sectional view of a portion of the connection between the bit and the rotatable output shaft.

FIG. 5 illustrates a cross-sectional view of a portion of the connection 200 between the bit 110 and the rotatable output shaft 125. The passageway 415 extends at least partially through the collar 205 along a direction that is transverse to a rotation axis R of the bit 110 and the rotatable output shaft 125. In some embodiments, the first passageway 415 (and the pin 310 when it is positioned in the first passageway 415) does not intersect the rotation axis R. In other words, the passageway 415 and the pin 310 are offset or spaced apart from the rotation axis R. This facilitates several advantages.

For example, the pin 310 does not need to bear torque forces transmitted from the rotatable output shaft 125 to the bit 110, it simplifies installation of the pin 310 in the passageway 415, and it facilitates the use of splines 210 on the rotatable output shaft 125 and corresponding splines 400 in the bore 405 of the collar 205. In addition, locating the notch 410 on the perimeter of the rotatable output shaft 125 (instead of having the pin 310 be fully encircled by the rotatable output shaft 125) enables the rotatable output shaft 125 to be positioned in the collar 205 in any rotational orientation about the rotation axis R (i.e., a user does not need to "clock" or align the rotatable output shaft 125 with the collar 205 except to enmesh the optional splines 210, 400).

Also visible in FIG. 5 is the notch 410 on the perimeter of the rotatable output shaft 125. The notch 410 allows the pin 310 to pass the rotatable output shaft 125 without engaging the rotatable output shaft for torque transfer. The notch 410 does not need to (and does not inherently) apply torque to the pin 310. Also visible in FIG. 5 is the alignment pin 425 (shown as a spring pin). The alignment pin 425 acts as a spacer to prevent the rotatable output shaft 125 from going too deep into the collar 205. More specifically, when the rotatable output shaft 125 bottoms out on the alignment pin 425, the notch 410 in the rotatable output shaft 125, and the passageway 415 in the collar 205, are aligned for the user to insert the pin 310 of the coupler 140. Not having to "clock' the rotatable output shaft 125 to the collar 205, and being able to let the rotatable output shaft 125 bottom out on the alignment pin 425, facilities a rapid installation and removal process at the connection 200.

Accordingly, when (a) the first bit end 130 is attached to the rotatable output shaft 125 via the collar, (b) the pin 310 of the coupler 140 is positioned in the passageway 415, and (c) the first arcuate portion 315 and the second arcuate portion 320 at least partially surround the outer surface or perimeter of the collar 205, (d) the pin 310 of the coupler 140 resists separation of the first bit end 130 from the rotatable output shaft 125. The splines 210, 400 transfer torque during operation of the auger system 100. Because embodiments of the connection 200 are narrow and do not necessarily have projections extending outwardly while the auger system 100 is in operation, the auger system 100 is safer than conventional augers because fewer objects exist at the connection 200 that could injure a user's body or catch on their clothing.

Connecting the Anchoring Device to the Powerhead/Frame

Figure 6A:
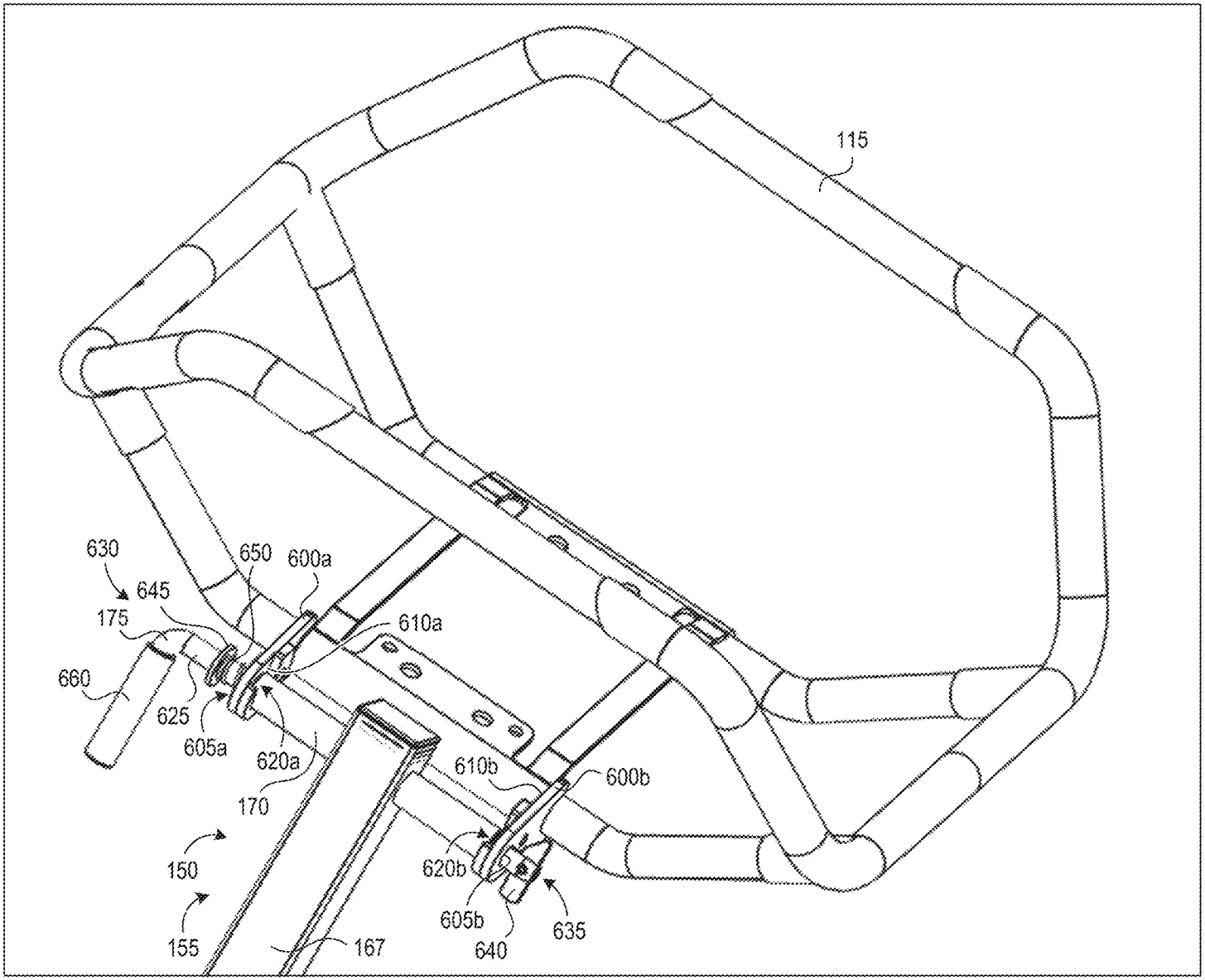
FIG. 6A illustrates a perspective view of a portion of the auger system shown in FIG. 1A.

FIG. 6A illustrates a perspective view of a portion of the auger system 100 shown in FIG. 1A. For simplicity in illustration, FIG. 6A omits the rotatable output shaft 125, the rotatable output source 120, and the bit 110 described above. FIG. 6A shows the frame 115 connected to the anchoring device 150 and several components described above, including the tube 170 and the pintle assembly 175 for forming a pivotable and releasable connection between the anchoring device 150 and the frame 115.

In some embodiments, the frame 115 includes or carries two lobes 600*a*, 600*b* extending from a side of the frame. In some embodiments, the lobes 600*a*, 600*b* may be similar or identical except that they may be mirror images of each other. Each lobe 600*a*, 600*b* includes its own aperture 605*a*, 605*b* through which the pintle assembly 175 can pass (e.g., when the tube 170 is between the lobes 600*a*, 600*b*). Each lobe has a corresponding lateral surface 610*a*, 610*b* facing the other corresponding lateral surface 610*a*, 610*b*.

Each lobe may further include a ledge 615*a*, 615*b* below the corresponding aperture 605*a*, 605*b* that extends from the corresponding lateral surface 610*a*, 610*b*. As described in additional detail below, the ledges 615*a*, 615*b* can support the tube 170 when the pintle assembly 175 is removed. In some embodiments, the ledges 615*a*, 615*b* are formed at the bottom of corresponding open slots 620*a*, 620*b* that open upward. The open slots 620*a*, 620*b* receive the tube 170 such that the tube 170 nests in the open slots 620*a*, 620*b* when the pintle assembly 175 is removed, which keeps the tube 170 from inadvertently falling out of place between the lobes 600*a*, 600*b* when the user is installing or removing the pintle assembly 175.

In some embodiments, the pintle assembly 175 may include a rod 625 having a first end 630 and a second end 635. A toggle 640 may be movably (e.g., pivotably) attached to the second end 635. The toggle 640 is pivotable between one or more first configurations or positions in which the toggle does not prevent the pintle assembly 175 from being pulled out of the auger system 100 (i.e., out of the tube 170 and the lobes 600*a*, 600*b*), and one or more second configurations or positions that prevent the pintle assembly 175 from being pulled out of the auger system 100. The rod 625 may include an optional shoulder 645 fixed to the first end 630, and an optional biasing element 650 positioned between the toggle 640 and the shoulder 645.

The shoulder 645 may be a radial protrusion from the rod 625, such as a partial or complete disk around the rod 625. In some embodiments, the biasing element 650 can include a spring around the rod 625. When the tube 170 is between the lobes 600*a*, 600*b*, and when the pintle assembly 175 extends through the apertures 605*a*, 605*b* in the lobes 600*a*, 600*b*, the anchoring device 150 is pivotably secured to the frame 115. The toggle 640 keeps the pintle assembly 175 from being pulled out. The biasing element 650 may be positioned between the shoulder 645 and the adjacent lobe 600*a* to bias the shoulder 645 away from the lobe 600*a* in a manner that biases the toggle 640 to press against the other lobe 600*b*, which prevents the toggle 640 from inadvertently moving to a position that would allow the pintle assembly 175 to be unintentionally pulled out.

Figure 6B:
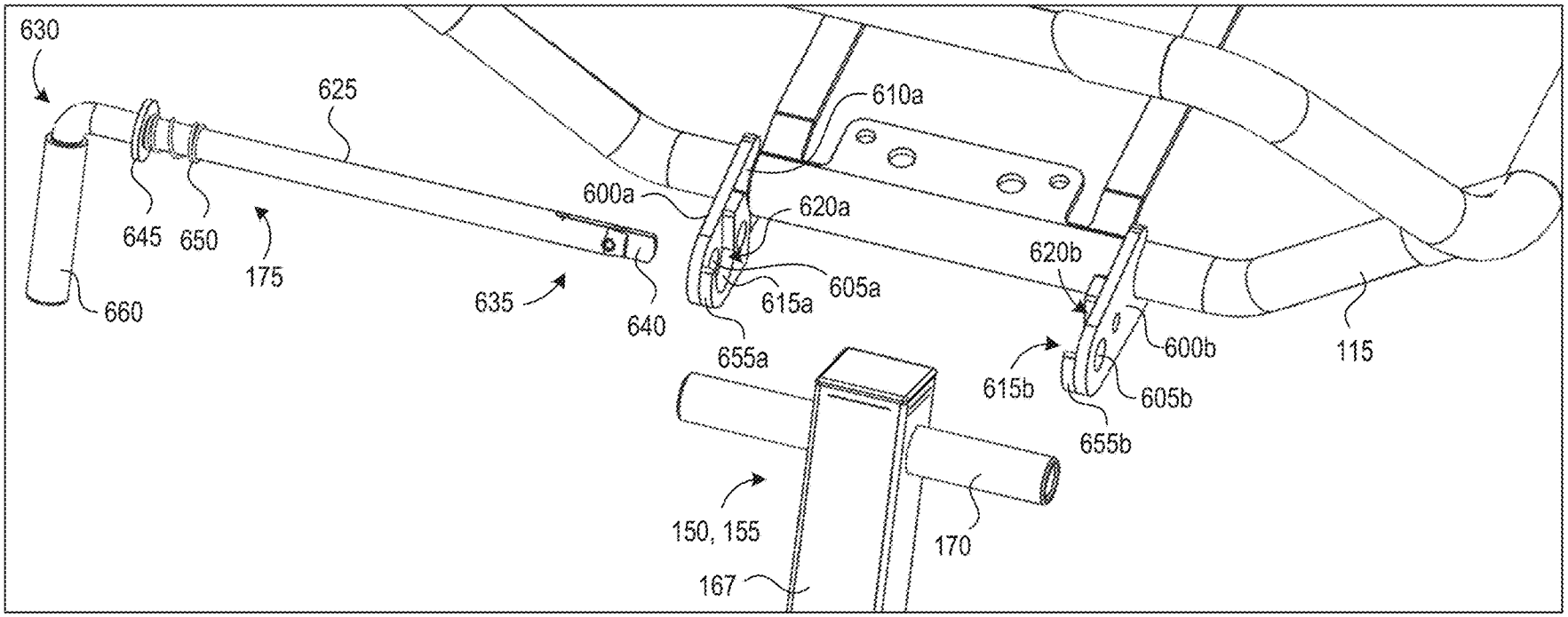
FIGS. 6B, 6C, and 6D illustrate partially exploded or partially assembled views of portions of the auger system.
Figure 6C:
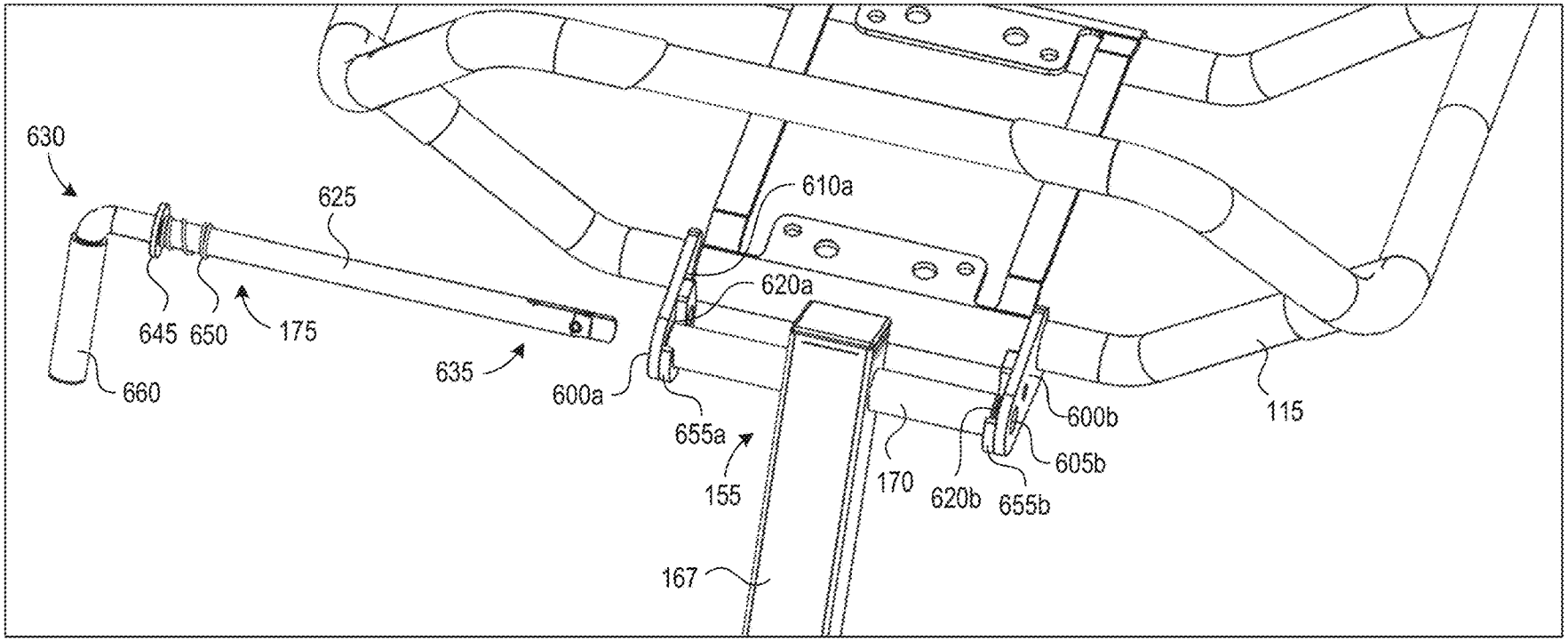
Figure 6D:
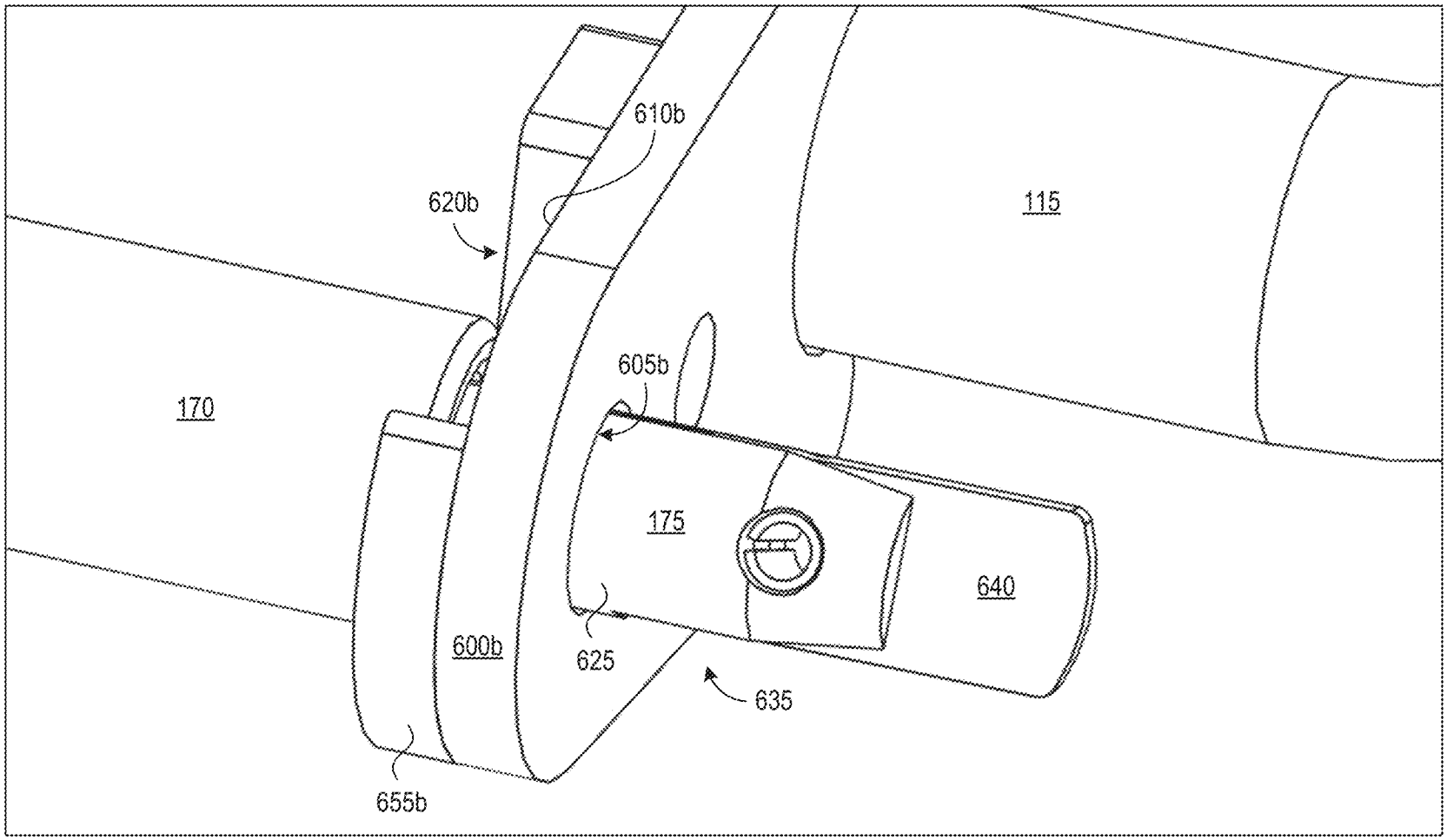

FIGS. 6B, 6C, and 6D illustrate attachment of the anchoring device 150 to the frame 115 using the pintle assembly 175, according to various embodiments of the present technology. Specifically, FIG. 6B illustrates a partially exploded view of a portion of the auger system 100 in which the pintle assembly 175 is out of the tube 170 and out of the apertures 605*a*, 605*b*, and in which the tube 170 is out of the open slots 620*a*, 620*b*. In the configuration shown in FIG. 6B, the anchoring device 150 is removed from the frame 115 and the auger system 100 can be used without the anchoring device 150. FIG. 6C illustrates a partially exploded view of a portion of the auger system 100 in which the tube 170 is positioned in the open slots 620*a*, 620*b*.

FIG. 6C represents a configuration in which a user may be installing or removing the anchoring device 150. With the tube 170 nested in the open slots 620*a*, 620*b*, the tube 170 is temporarily secured to make installation of the pintle assembly 175 easy, and to resist the anchoring device 150 from falling before an operator has an opportunity to install the pintle assembly 175. With the toggle 640 oriented such that its longer end is parallel or generally parallel with the rod 625, toggle 640 and the rod 625 can pass through one aperture 605*a*, then through the tube 170, then through the other aperture 605*b*.

FIG. 6D is a detailed view of the second end 635 of the rod 625 protruding from the aperture 605*b* while the tube 170 rests in the open slot 620*b*. Rotating the toggle 640 to make its long end transverse to the rod 625 or otherwise in a position where the toggle 640 cannot pass through the aperture 605*b* will essentially lock the anchoring device 150 to the frame 115, as generally shown in FIG. 6A. With reference to FIGS. 6B and 6D, in some embodiments, the ledges 615*a*, 615*b* or the open slots 620*a*, 620*b* can be formed in plate elements 655*a*, 655*b* attached to or integral with the corresponding lobes 600*a*, 600*b*. In some embodiments, the pintle assembly 175 may include a handle 660 attached to or integral with the rod 625, wherein the handle 660 extends transversely relative to the rod 625.

Embodiments of the present technology provide several advantages over conventional systems and components. For example, couplers according to the present technology are faster to install for connecting the bit to the powerhead, they do not include protruding objects that can catch on clothing or other objects, the offset pin arrangement (in addition to the splined connection between the bit and the rotatable output shaft) avoids stressing the connection pin and the material engaging the connection pin with torque forces, thereby increasing durability of the connection, and because the pin does not need to pass through the rotatable output shaft, it does not need to be "clocked" to the bit, so the bit can be installed faster than in conventional systems in which a user has to clock or orient the bit to the rotating output in order to connect them together.

As visible in the figures, in some embodiments, a gap between the portions of the coupler enables a user to quickly grasp the portions of the coupler to remove it without a need for tools. The pintle assembly 175 facilitates a secure connection between the anchoring device 150 and the frame 115. The tube 170 being nestable on the ledges 615*a*, 615*b* or in the slots 620*a*, 620*b* enables a solo user to support the frame 115 while installing the pintle assembly 175 for the secure connection, without the anchoring device 150 falling over or requiring an additional user to support the anchoring device 150 during installation.

From the foregoing, it will be appreciated that specific embodiments of the presently disclosed technology have been described herein for purposes of illustration, but that various modifications may be made without deviating from the scope of the technology. For example, although the collar 205 is described and illustrated as being part of the bit 110, in some embodiments the collar 205 may be fixed to the rotatable output shaft 125, and the bit 110 may include a shaft portion (e.g., a splined shaft portion) that is positionable in the collar 205. In other words, in some embodiments, instead of the male shaft going into a female bore on the bit, a male shaft on the bit can go into a female bore attached to the rotating output. Aspects of embodiments of the present technology may be applied to other tools or devices that have rotating output or replaceable rotating implements.

Certain aspects of the technology described in the context of particular embodiments may be combined or eliminated in other embodiments. Further, while advantages associated with certain embodiments of the presently disclosed technology have been described in the context of those embodiments, other embodiments may also exhibit such advantages, and not all embodiments need necessarily exhibit such advantages to fall within the scope of the technology. Accordingly, the disclosure and associated technology can encompass other embodiments not expressly shown or described herein.

What is claimed is:

1. An auger system comprising:

(a) a powerhead, wherein the powerhead comprises a frame and a rotatable output shaft configured to be driven by a rotatable output source;

(b) a bit having a first bit end and a second bit end, wherein the first bit end is attachable to the rotatable output shaft via a collar, the second bit end carries a cutting portion for cutting into a medium, the collar includes a passageway extending at least partially through the collar along a direction that is transverse to a rotation axis of the rotatable output shaft, wherein the passageway does not intersect the rotation axis;

(c) a coupler positionable around the collar, wherein the coupler comprises an inner surface positionable to face the collar, an outer surface positionable to face away from the collar, and a pin extending from the inner surface, wherein the pin is positionable in the passageway;

(d) an anchoring device having a first anchoring device end and a second anchoring device end positioned opposite the first anchoring device end along a longitudinal axis of the anchoring device, wherein the first anchoring device end is attachable to the frame and removable from the frame, the second anchoring device end is configured to engage a fixed surface, and the anchoring device comprises a tube (i) passing through the first anchoring device end along a direction transverse to the longitudinal axis or (ii) attached to the first anchoring device end and extending along a direction transverse to the longitudinal axis; and (e) a pintle assembly, wherein the pintle assembly comprises (i) a rod extending between a first end of the rod and a second end of the rod, (ii) a toggle pivotably attached to the second end of the rod, (iii) a shoulder fixed to the first end of the rod, and (iv) a biasing element on the rod between the shoulder and the toggle;

(f) wherein:

(i) the frame carries two lobes extending from a first side of the frame, wherein, for each lobe, the lobe has an aperture and a ledge below the aperture and that extends from a lateral surface of the lobe, and wherein the lateral surfaces of the lobes face each other such that the ledges extend toward each other;

(ii) the tube is positionable on the ledges and between the lobes;

(iii) the second end of the rod and the toggle are positionable to pass through the apertures and through the tube, wherein when the two lobes are between the toggle and the first end of the rod and the rod extends through the tube and the apertures, the toggle is movable between a first position in which the toggle resists removal of the pintle assembly from the apertures and the tube, and a second position in which the toggle permits removal of the pintle assembly from apertures and the tube;

(iv) when the two lobes are between the toggle and the first end of the rod, the biasing element biases the shoulder away from the lobes and biases the toggle toward the lobes; and (g) wherein:

(i) the coupler comprises a first arcuate portion pivotably attached to, or pivotably connectable to, a second arcuate portion;

(ii) the first arcuate portion has a first arcuate length, the second arcuate portion has a second arcuate length, and the second arcuate length is greater than the first arcuate length;

(iii) at least one of the first arcuate portion or the second arcuate portion comprises a resilient or elastic material biasing the at least one of the first arcuate portion or the second arcuate portion toward greater curvature;

(iv) the first arcuate portion carries the pin; and (v) when the first bit end is attached to the rotatable output shaft via the collar, when the pin is positioned in the passageway, and when the second arcuate portion and the first arcuate portion at least partially surround a perimeter of the collar, the pin resists separation of the first bit end from the rotatable output shaft.

2. The auger system of claim 1, wherein:

the rotatable output shaft comprises one or more first splines;

the collar comprises one or more second splines; and the one or more first splines engage the one or more second splines to resist relative rotation between the rotatable output shaft and the collar.

3. The auger system of claim 1, wherein:

the first bit end comprises the collar; and the rotatable output shaft is positionable in the collar.

4. The auger system of claim 1, wherein the first arcuate portion is pivotably connectable to the second arcuate portion via a hinge.

5. The auger system of claim 1, wherein the first arcuate portion is separate from, and connectable to, the second arcuate portion.

6. The auger system of claim 1, wherein the cutting portion comprises a helical blade.

7. The auger system of claim 1, wherein the anchoring device comprises one or more wheels positioned toward the second anchoring device end.

8. The auger system of claim 1, wherein each ledge is positioned at a bottom of an open slot carried by each lobe, wherein each open slot extends between the ledge and an open end of the slot.

9. The auger system of claim 1, wherein each ledge is formed in a plate element attached to or integral with each corresponding lobe.

10. The auger system of claim 1, wherein the biasing element comprises a spring.

11. The auger system of claim 1, wherein the pintle assembly comprises a handle attached to or integral with the rod, wherein the handle extends transversely relative to the rod.

12. An auger system comprising:

(a) a powerhead, wherein the powerhead comprises a frame and a rotatable output shaft;

(b) a bit having a first bit end and a second bit end, wherein the first bit end is attachable to the rotatable output shaft via a collar, the second bit end carries a cutting portion for cutting into a medium, the collar includes a passageway extending at least partially through the collar along a direction that is transverse to a rotation axis of the rotatable output shaft, wherein the passageway does not intersect the rotation axis; and (c) a coupler positionable around the collar, wherein the coupler comprises an inner surface positionable to face the collar, an outer surface positionable to face away from the collar, and a pin extending from the inner surface, wherein the pin is positionable in the passageway;

(d) wherein:

(i) the coupler comprises a first arcuate portion pivotably attached to, or pivotably connectable to, a second arcuate portion;

(ii) at least one of the first arcuate portion or the second arcuate portion comprises a resilient or elastic material biasing the at least one of the first arcuate portion or the second arcuate portion toward greater curvature;

(iii) the first arcuate portion carries the pin; and (iv) when the first bit end is attached to the rotatable output shaft via the collar, when the pin is positioned in the passageway, and when the second arcuate portion and the first arcuate portion at least partially surround a perimeter of the collar, the pin resists separation of the first bit end from the rotatable output shaft, and the pin is positioned in a notch at a perimeter of the rotatable output shaft.

13. The auger system of claim 12, further comprising:

an anchoring device having a first anchoring device end and a second anchoring device end positioned opposite the first anchoring device end along a longitudinal axis of the anchoring device, wherein the first anchoring device end is attachable to the frame and removable from the frame, and the second anchoring device end is configured to engage a fixed surface; and a pintle assembly for connecting the first anchoring device end to the frame.

14. The auger system of claim 13, wherein:

the anchoring device comprises a tube positioned toward the first anchoring device end and extending along a direction transverse to the longitudinal axis; and the pintle assembly comprises a rod extending between a first end of the rod and a second end of the rod.

15. The auger system of claim 14, wherein the pintle assembly further comprises at least one of:

(a) a toggle pivotably attached to the second end of the rod, wherein the toggle is movable between a first position in which the toggle resists removal of the pintle assembly from the frame and the tube, and a second position in which the toggle permits removal of the pintle assembly from the frame and the tube; or (b) a shoulder fixed to the first end of the rod and a biasing element on the rod between the shoulder and the second end of the rod, wherein the biasing element biases the shoulder away from a lobe on the frame.

16. The auger system of claim 13, wherein:

the frame carries two lobes extending from a first side of the frame, wherein each lobe has an aperture; and the pintle assembly is positionable to extend through the apertures to connect the first anchoring device end to the frame.

17. An auger system comprising:

(a) a powerhead comprising a frame;

(b) an anchoring device having a first anchoring device end and a second anchoring device end positioned opposite the first anchoring device end along a longitudinal axis of the anchoring device, wherein the first anchoring device end is attachable to the frame and removable from the frame, and the anchoring device comprises a tube extending along a direction transverse to the longitudinal axis and positioned toward the first anchoring device end; and (c) a pintle assembly, wherein the pintle assembly comprises (i) a rod extending between a first end of the rod and a second end of the rod, and (ii) a toggle pivotably attached to the second end of the rod;

(d) wherein:

(i) the frame carries two lobes extending from a first side of the frame, wherein for each lobe, the lobe has an aperture and a ledge below the aperture and extending from a lateral surface of the lobe, and wherein the lateral surfaces of the lobes face each other such that the ledges extend toward each other;

(ii) the tube is positionable on the ledges and between the lobes; and (iii) the second end of the rod and the toggle are positionable to pass through the apertures and through the tube, wherein when the two lobes are between the toggle and the first end of the rod and the rod extends through the tube and the apertures, the toggle is movable between a first position in which the toggle resists removal of the pintle assembly from the apertures and the tube, and a second position in which the toggle permits removal of the pintle assembly from apertures and the tube.

18. The auger system of claim 17, wherein at least one of:

the tube extends through the first anchoring device end; or the tube is attached to the first anchoring device end.

19. The auger system of claim 17, wherein:

the pintle assembly further comprises a shoulder fixed to the first end of the rod;

the pintle assembly further comprises a biasing element on the rod between the shoulder and the toggle; and when the two lobes are between the toggle and the first end of the rod, the biasing element biases the shoulder away from the lobes and biases the toggle toward the lobes.

20. The auger system of claim 17, wherein the frame carries a rotatable output shaft, and the auger system further comprises:

(a) a bit having a first bit end and a second bit end, wherein the first bit end includes or carries a collar for receiving the rotatable output shaft, and wherein the collar includes a passageway extending transverse to a rotation axis of the rotatable output shaft and does not intersect the rotation axis; and (b) a coupler positionable around the collar, wherein the coupler comprises a pin, and wherein the pin is positionable in the passageway to resist removal of the rotatable output shaft from the collar.

21. The auger system of claim 20, wherein:

(a) the coupler comprises a first arcuate portion and a second arcuate portion movable relative to the first arcuate portion;

(b) the first arcuate portion has a first arcuate length, the second arcuate portion has a second arcuate length, and the second arcuate length is greater than the first arcuate length; and (c) the first arcuate portion carries the pin.

22. The auger system of claim 20, wherein:

the coupler comprises a first arcuate portion and a second arcuate portion movable relative to the first arcuate portion; and at least one of the first arcuate portion or the second arcuate portion comprises a resilient or elastic material biasing the at least one of the first arcuate portion or the second arcuate portion toward having greater curvature.

* * * * *